US011846154B2

(12) United States Patent
Marchbank et al.

(10) Patent No.: US 11,846,154 B2
(45) Date of Patent: Dec. 19, 2023

(54) PORTABLE FOAM INJECTION SYSTEM

(71) Applicant: HEARTLAND REVITALIZATION SERVICES INC., Aldersyde (CA)

(72) Inventors: Brian Marchbank, Stavely (CA); Jonathan Emsheimer, High River (CA); Wilfrid Davis, Cayley (CA); Tyler Mueller, Airdrie (CA); Stephen Hurst, High River (CA)

(73) Assignee: Heartland Revitalization Services Inc., Aldersyde (CA)

( * ) Notice: Subject to any disclaimer, the term of this patent is extended or adjusted under 35 U.S.C. 154(b) by 36 days.

(21) Appl. No.: 17/545,707

(22) Filed: Dec. 8, 2021

(65) Prior Publication Data

US 2022/0186581 A1 Jun. 16, 2022

Related U.S. Application Data

(60) Provisional application No. 63/124,468, filed on Dec. 11, 2020.

(51) Int. Cl.
*E21B 17/20* (2006.01)
*E21B 33/138* (2006.01)

(52) U.S. Cl.
CPC ..... *E21B 33/138* (2013.01); *E21B 17/206* (2013.01)

(58) Field of Classification Search
CPC ..... E21B 33/138; E21B 17/206
See application file for complete search history.

(56) References Cited

U.S. PATENT DOCUMENTS 3,214,144 A * 10/1965 Fritz ..... B29B 7/7447 366/181.8
6,155,351 A * 12/2000 Breedlove ..... A62C 5/02 169/85
7,617,873 B2 11/2009 Lovell et al.
(Continued)

FOREIGN PATENT DOCUMENTS

AU 2009201132 B2 12/2011
CA 2547878 C 7/2010
(Continued)

*Primary Examiner* — Taras P Bemko
(74) *Attorney, Agent, or Firm* — FIELD LLP

(57) ABSTRACT

A portable system is provided for foam injection. The system includes two or more tanks of foam-producing components; a pump associated with each of the two or more tanks; a length of modified conduit; a conduit interjector; and a wireline system. The conduit is pushable by the injector into cavities to be injected with foam and extractable therefrom. A method is further provided for foam injection at a remote location. The method includes the steps of transporting the portable system to the remote location; injecting the modified conduit into a distal end of a cavity to be foamed; pumping the foam-producing components from the two or more tanks via the pumps, each through a component line running through the modified conduit; forming and expansion of a foam by the foam-producing components exiting a nozzle of the modified conduit and contacting one another; and pulling the modified conduit from the distal end of the cavity to a proximal end of the cavity, while foaming the cavity from the distal end to the proximal end as the modified cavity is pulled.

19 Claims, 6 Drawing Sheets

(56) References Cited

U.S. PATENT DOCUMENTS

| | | | | |
|---|---|---|---|---|
| 8,555,974 | B2 | 10/2013 | Moncus et al. | |
| 8,857,526 | B2 | 10/2014 | Erkol et al. | |
| 2003/0196793 | A1* | 10/2003 | Crawford | E21B 43/168 166/305.1 |
| 2004/0123991 | A1* | 7/2004 | Hanratty | A62C 31/12 169/44 |
| 2004/0244993 | A1* | 12/2004 | Crawford | E21B 17/203 166/77.2 |
| 2005/0263281 | A1* | 12/2005 | Lovell | E21B 17/206 166/250.07 |
| 2013/0284422 | A1* | 10/2013 | Irvine | E21B 37/00 210/167.01 |
| 2019/0112522 | A1* | 4/2019 | Khamatnurova | C09K 8/94 |

FOREIGN PATENT DOCUMENTS

| | | | |
|---|---|---|---|
| CN | 2921267 | Y | 7/2007 |
| CN | 204532296 | U | 8/2015 |
| CN | 107956459 | A | 4/2018 |
| JP | 2007512453 | A | 5/2007 |
| RU | 2482268 | C1 | 5/2013 |
| RU | 2682298 | C1 | 3/2019 |
| WO | 9735093 | A1 | 9/1997 |

* cited by examiner

PORTABLE FOAM INJECTION SYSTEM

FIELD

The present disclosure relates to a portable system and a method for foam injection.

BACKGROUND

Orphaned wells are decommissioned in a number of ways. One traditional system involves pulling any production strings or other pipe out of the well and then pumping cement down into the well, which may or may not be cased or lined. The traditional cementing process requires significant equipment and set up, and a large number of operators. Since orphaned wells are in remote and varied locations, transportation to such sites is a challenge and there is typically little existing infrastructure at such sites.

Systems are known for injecting foam into surface cavities for construction applications, and sometimes in surface or underground pipelines (not wells) in which a hose system is pulled through the pipeline by a robotic mechanism and the retracted back once the foaming is complete, there is no ability to push and pull the hose and it would not be useable in a vertical well.

U.S. Pat. No. 8,857,526B2 teaches an inflatable foam packer configured for self-deployment in a well. The foam packer may be primarily an open or closed-cell polymer foam positioned downhole in a pre-compressed state. Subsequently, the packer may be released from a housing for self-deployment and engagement with a wall of the well. Such a packer may serve the conventional purpose of a downhole packer or other similar restriction devices.

U.S. Pat. No. 7,617,873B2 teaches an apparatus having a fiber optic tether disposed in coiled tubing for communicating information between downhole tools and sensors and surface equipment and methods of operating such equipment. Optical tools or sensors may be the tools or sensors of the coiled tubing operation. Stimulation performed using the coiled tubing apparatus comprising a fiber optic tether include well treatment fluid introduced into a wellbore through coiled tubing. The treatment fluid may be introduced using one of the various tools known in the art for that purpose, e.g., nozzles attached to the coiled tubing.

WO9735093A1 presents a method and apparatus for performing well operations, such as measuring or forming or testing or treating or the like, including the use of coiled-in-coiled tubing (CCT) connected to a bottom hole assembly package (BHA), such that the assembly is in communication with both fluid conduits defined by the coiled-in-coiled tubing. Treating might also refer to the addition of one or more substances including foam. A wireline can extend through one of the two coiled-in-coiled tubing conduits to establish electrical communication between the surface and the bottom hole assembly package.

Hose and flexible tubing systems currently deployed are often not robust enough to withstand wellbore conditions and tend to be easily damaged. As well, while hose and flexible tubing systems may be more easily deployable in vertical wells where there is gravity to assist in lowering the hose, they are too flexible and soft to be pushed into horizontal wells. Other systems in the prior art tend to be large and cumbersome and also require multiple pieces of equipment and operators.

A need therefore exits in the art for a system that is transportable, compact and relatively contained for transit to remote locations for foam injection operations, one example of which could be orphaned well sites. The system should also be rugged enough for deployment in long or deep cavities, including for example both horizontal and vertical wells.

SUMMARY

A portable system is provided for foam injection. The system comprises two or more tanks of foam-producing components; a pump associated with each of the two or more tanks; a length of modified conduit; a conduit interjector; and a wireline system. The conduit is pushable by the injector into cavities to be injected with foam and extractable therefrom.

A method is further provided for foam injection at a remote location. The method comprises the steps of transporting the portable system described above to the remote location; injecting the modified conduit into a distal end of a cavity to be foamed; pumping the foam-producing components from the two or more tanks via the pumps, each through a component line running through the modified conduit; forming and expansion of a foam by the foam-producing components exiting a nozzle of the modified conduit and contacting one another; and pulling the modified conduit from the distal end of the cavity to a proximal end of the cavity, while foaming the cavity from the distal end to the proximal end as the modified cavity is pulled.

It is to be understood that other aspects of the present disclosure will become readily apparent to those skilled in the art from the following detailed description, wherein various embodiments of the disclosure are shown and described by way of illustration. As will be realized, the disclosure is capable of other and different embodiments and its several details are capable of modification in various other respects, all without departing from the spirit and scope of the present disclosure. Accordingly the drawings and detailed description are to be regarded as illustrative in nature and not as restrictive.

BRIEF DESCRIPTION OF THE DRAWINGS

A further, detailed, description of the disclosure, briefly described above, will follow by reference to the following drawings of specific embodiments of the disclosure. The drawings depict only typical embodiments of the disclosure and are therefore not to be considered limiting of its scope. In the drawings.

Figure 1:
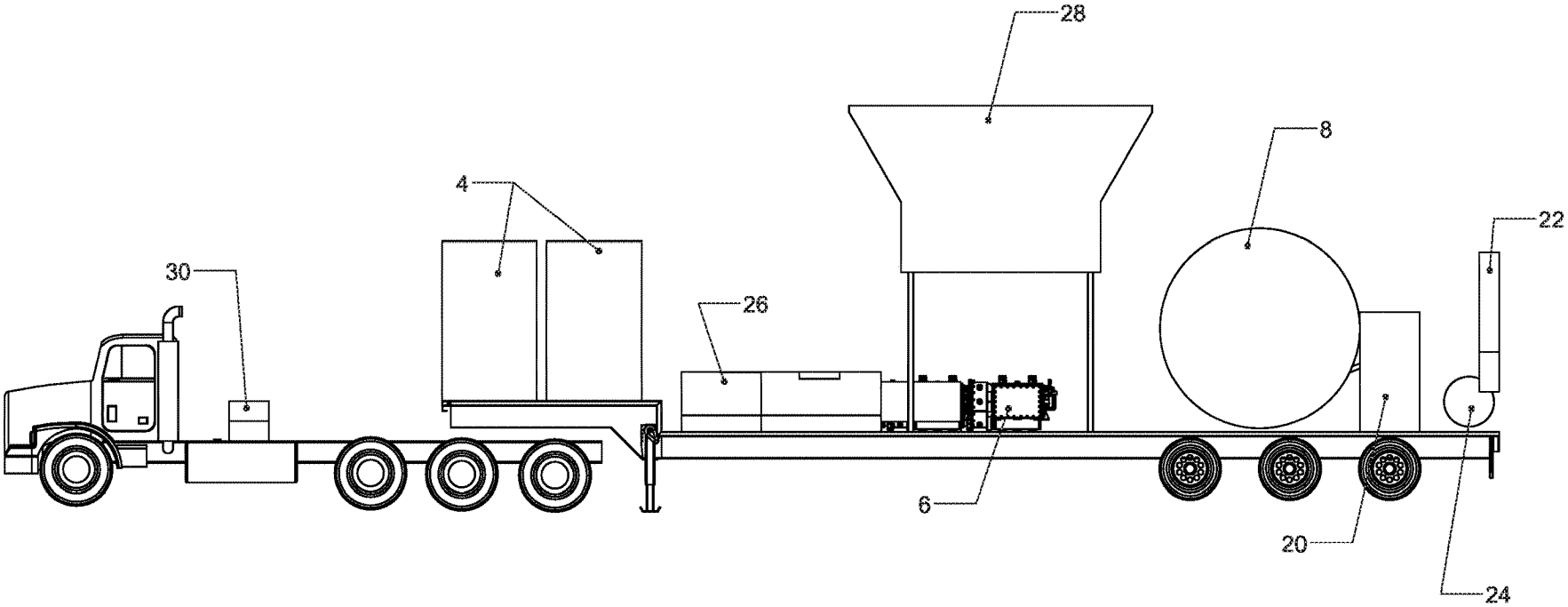
FIG. 1 is side elevation view of one embodiment of the present skid mounted system.
Figure 2:
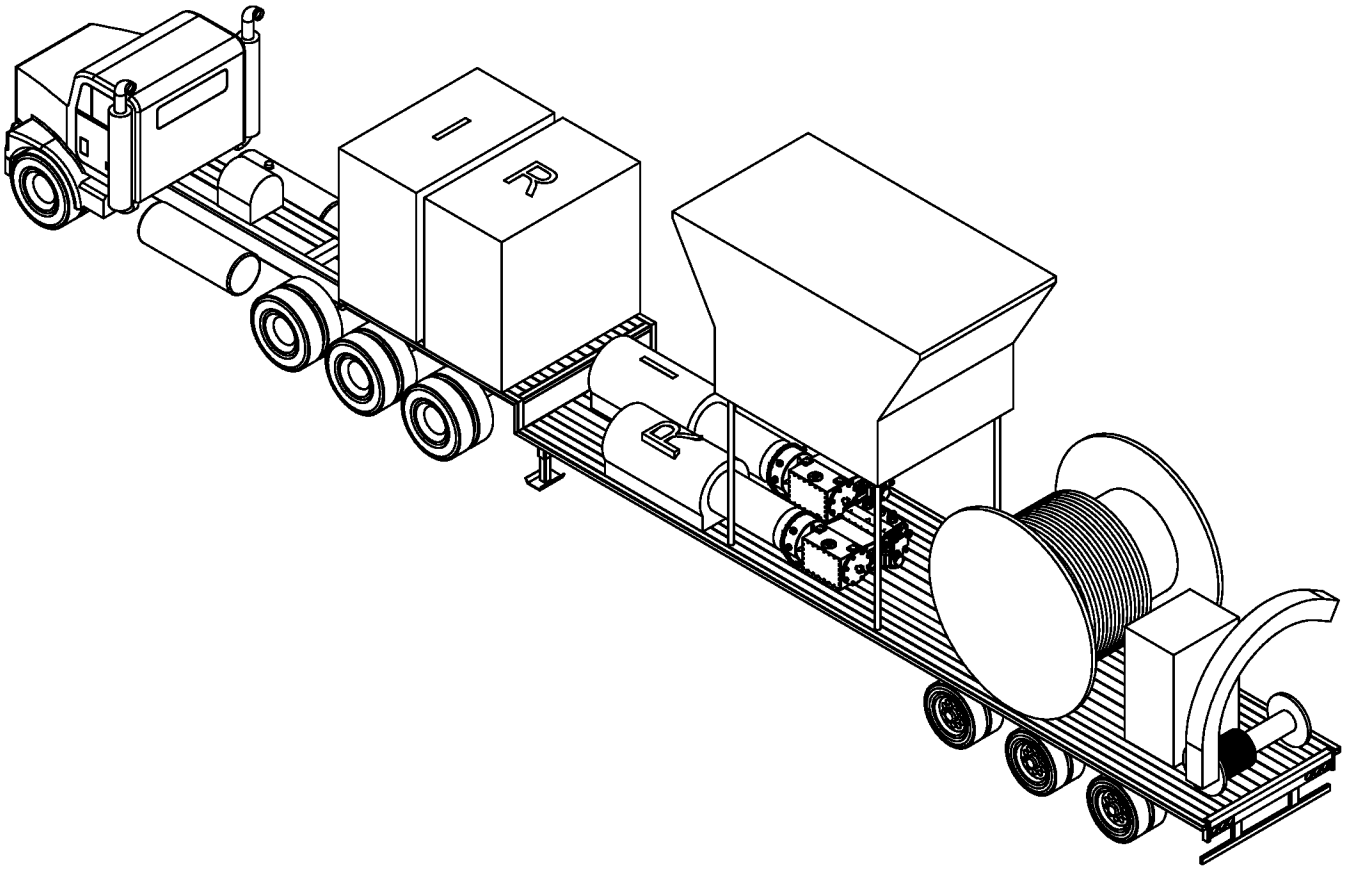
FIG. 2 is a top perspective view of the skid mounted system of FIG. 1.

The drawings are not necessarily to scale and in some instances proportions may have been exaggerated in order to more clearly depict certain features.

DETAILED DESCRIPTION

The description that follows and the embodiments described therein are provided by way of illustration of an example, or examples, of particular embodiments of the principles of various aspects of the present disclosure. These examples are provided for the purposes of explanation, and not of limitation, of those principles and of the disclosure in its various aspects.

The present invention relates to a portable system for high density foam injection. The present system can be used, in one example, instead of a complex cementing process for decommissioning orphaned wells. The present system and all of its elements can be contained on a truck flatbed or as a skid and thus provides a small footprint and portability. A larger trailer mounted system could also be used for larger applications or deeper wells.

The present system uses a high density, multi-component foam in which one or more chemical components are injected into the well, where they mix and form the foam. The foam types are similar to those used in building construction applications such as foam insulation, or in foundation repairs or stabilizing work above ground. In such cases, the above ground foam injection system used is not particularly sturdy or robust. The foam types should meet environmental safety in terms of impact to ground water or other protected resources.

In one application of the system, the chemical components can be injected into wells such as orphan wells, where the foam forms and expands to fill the well. In such uses, lower volumes of the chemical components are needed to completely fill the wells, leading to less material needing to be transported to the well site.

It would be understood that the system of present disclosure can also be used in any circumstance where foam injection is need in remote or space constricted environments.

With reference to the attached drawings, all of the components of the system 100 are containable on a truck mounted skid 2, including tanks 4A/B of the foam-producing chemical components, chemical pumps 6A/B and associated motors 26A/B, a reel 8 of modified conduit 40, said modified conduit 40 being either a modified coil tubing (CT) 10 or a modified flexible hose 12, a conduit interjector 20 and goose neck lead 22, and a wireline system 24. A generator 30 also located on the skid 2 can provide local power to all elements of the system 100.

In preferred embodiment, a control room 28 is also provided, more preferably in the form of a cab which can be raised and lowered from the skid. The cab can be raised for ease of monitoring levels in tanks 4A/B, better visibility of wellhead 34, and for maintenance of equipment located under the cab, and can be lowered for transport.

The control room 28 allows central control of the wireline system 24, injector 20 and goose neck 22, pumps 6A/6B, and power/sensors in the present modified CT 10 or flexible hose 12, as described below.

Figure 6B:
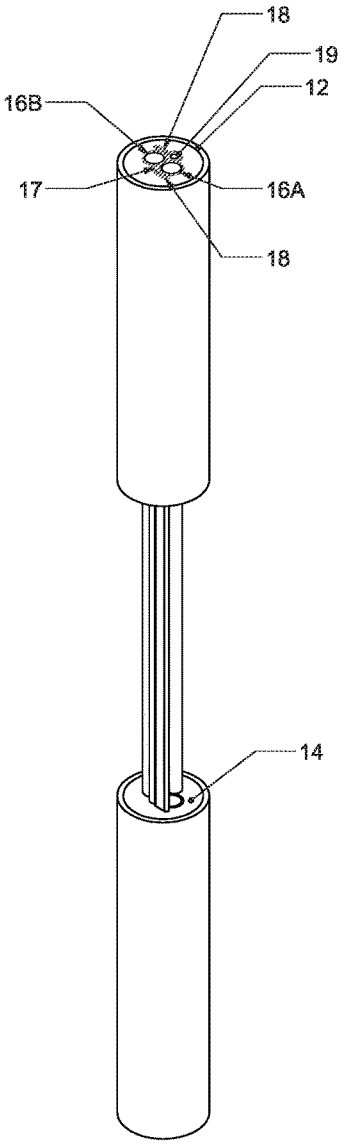
FIG. 6B is a partial cutaway perspective view of one embodiment of the present modified flexible tubing, showing components carried therein.
Figure 6A:
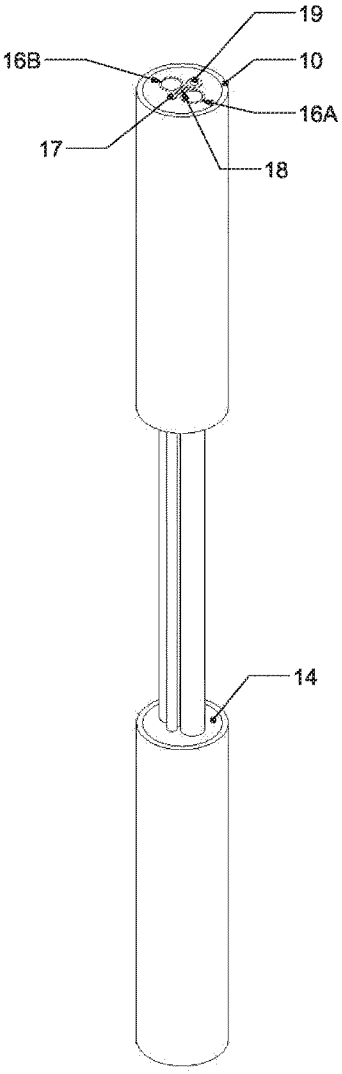
FIG. 6A is a partial cutaway perspective view of one embodiment of the present modified coiled tubing, showing components carried therein.

With reference to FIGS. 6A and 6AB, the present system 100 includes a modified CT 10 or flexible hose 12 that can be run on the reel 8. The modified coiled tubing 10 is standard coiled tubing and the modified flexible hose 12 is standard flexible hose that can be used with a standard coiled tubing injector to be run downhole. The modification lies in what is contained within the coiled tubing 10 or hose 12.

The modified coiled tubing 10 or flexible hose 12 is filled with insulation 14. Run through the insulation are, for example, two lines 16 A/B carrying each of the chemical components of the foam, pumped by pumps 6A/B from the tanks 4A/B on the skid 2. It would of course be understood by a person of skill in the art that the number of tanks 4, pumps 6, motors 26 and lines 16 will depend on the number of chemical components used to form the foam. The modified coiled tubing 10 or flexible hose 12 may also include heat tracing 18 to maintain the chemical components at a suitable temperature, which is particularly useful for winter operations.

An optional power/sensor cable line 17 allows for the running of a camera, sensors or other electrical equipment to monitor the operation and well condition. The optional camera and sensors allow accuracy of placement of the foam. Camera and sensor data can be viewed in control room 28 and operational decisions made therefrom. The power/sensor cable line 17 can preferably be made in the form of fiber optic cables.

An optional purge line 19 provides compressed gas or air to clean out a nozzle head (not shown) at the far end of the modified CT 10 or flexible hose 12, through which the chemicals combine to make the foam. A source of compressed gas or air (not shown) can also be included on the skid 2, or purge line 19 can be connected to a local source at the wellsite.

It has been found that by containing all of these elements in standard coiled tubing, a standard coiled tubing injector can be used to run the system downhole. By containing elements within flexible but rigid tubing, the elements are protected from wear as they are deployed downhole.

The modified CT 10 is robust and provides the ability to push the CT 10 downhole into the well and pull it up, unlike a more sensitive foam injection system used in above ground building construction applications. This robust push and pull ability also allows for use of the present system not only in vertical wells but also in horizontal wells and other foaming locations that are deep or otherwise deviated or difficult to reach.

In foaming operations in shallow or vertical wells, the flexible hose 12 can provide a less expensive option where there is less need to pull or push over great distances.

Figure 3:
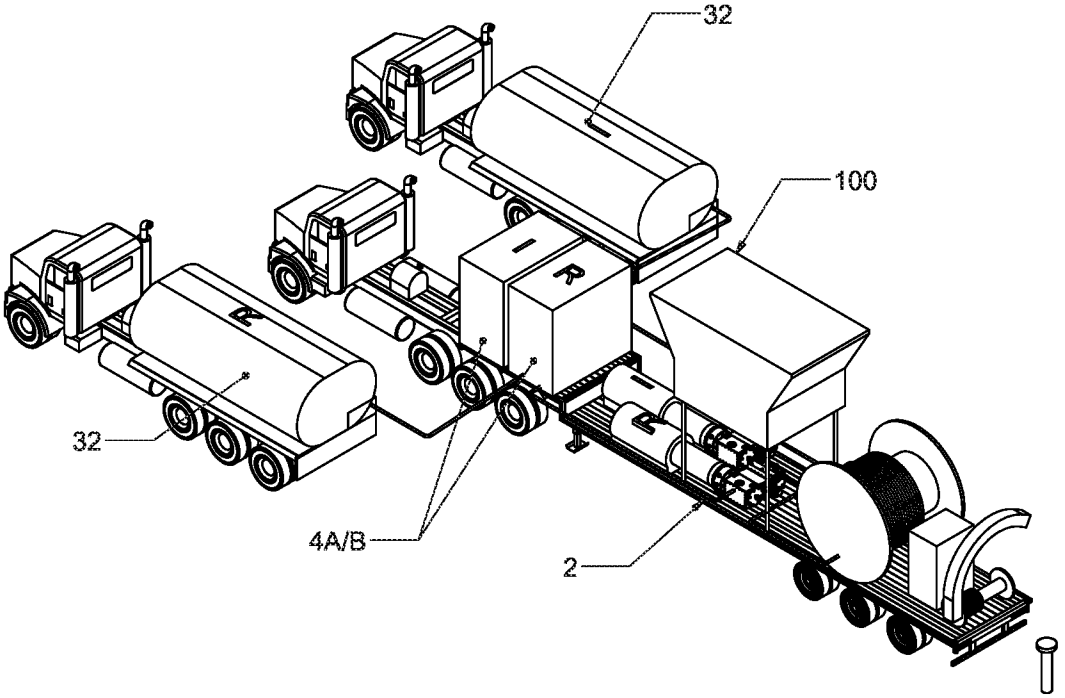
FIG. 3 is a top perspective view of the skid mounted system of FIG. 1 in a ready for transport position, together with trucks providing chemical component supply.

With references to FIGS. 3-6, in operation, the tanks 4A/B of the present system 100 would be filled with their respective foam-making chemical components. This could be done at a central filling station from stationary sources, or as illustrated in FIG. 3, could be done from tank trucks 32 at a central or remote location.

Figure 4:
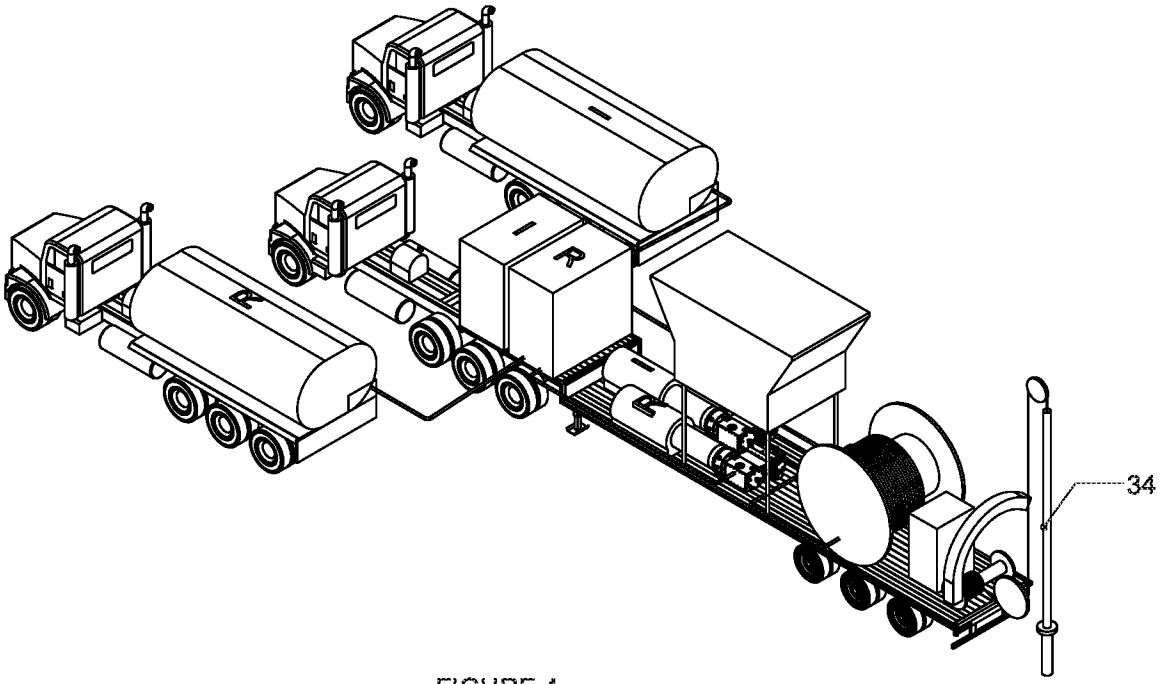
FIG. 4 is a top perspective view of the skid mounted system of FIG. 1 in a wireline deployed position.

As seen in FIG. 4, once at the wellhead 34, the wireline system 24 can optionally be deployed down the well to scan the wellbore and take necessary measurements ahead of foaming. The wireline system 24 may deploy any number of types of sensors and may include a camera, temperature sensor and calipers among others, for returning well information useful in determining the foam requirements.

It would be well understood by a person of skill in the art that use of the wireline system 24 to determine location conditions is optional and may not be required in all operations.

Once the wellbore conditions are determined, the foaming operation can begin.

Figure 5:
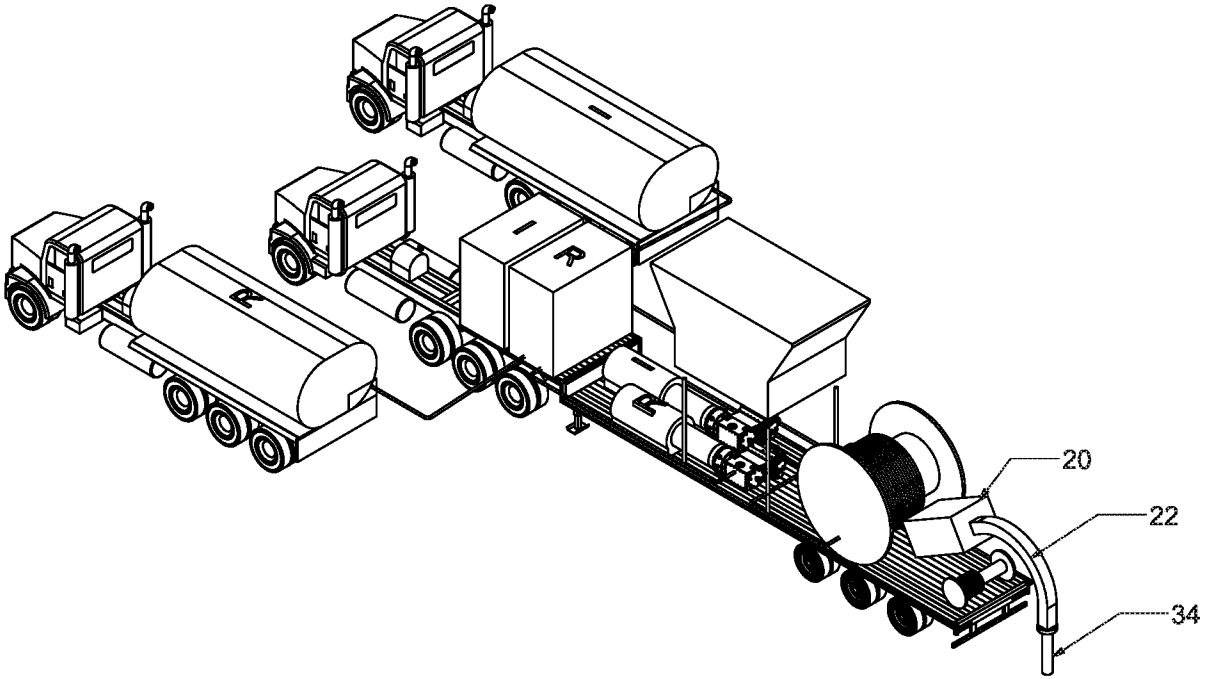
FIG. 5 is a top perspective view of the skid mounted system of FIG. 1, in a gooseneck deployed position.

With reference to FIG. 5, the injector 20 and mounted gooseneck 22 are connected to the wellhead 34 and the modified CT 10 or flexible hose 12 are injected from reel 8 through the gooseneck 22 and into the well. The modified CT 10 or hose 12 are injected all the way to the far end of the well (often called the toe end in horizontal wells). At this point pumping of the chemical components can begin.

Chemical components are pumped from tanks 4A/B via pumps 6A/B down through lines 16A/B and into the toe end of the well via a nozzle (not shown). As the chemical components exit the nozzle and come into contact with one another, the foam forms and expands. Sensors and cameras in power/sensor cable line 17 allow operators to observe and collect data on foaming operations from control room 28. As foaming proceeds, the modified CT 10 or hose 12 is pulled uphole by injector 20, foaming the well from far end to near end as it is pulled out of hole. Insulation 14 and optional heat tracing 18 contained in the modified CT 10 or hose 12 ensure that the chemical components are kept at predetermined temperatures as needed. Should any clogging of the nozzle occur, pressurized air from purge line 19 can be supplied to unclog the nozzle.

While the present portable system 100 is described above for use in foam filling of orphan wells, it would be understood by a person of skill in the art that other remote or otherwise inaccessible foaming operations can also be conducted by this system. The present system allows for scanning and foaming operations with quick set up and efficient operation. The presence of the power/sensor cable line 17 provides accuracy of foam placement to meet quality requirements and legislation. The system presents a small and portable footprint containing all of the equipment needed for application.

The previous description of the disclosed embodiments is provided to enable any person skilled in the art to make or use the present disclosure. Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A portable system for foam injection, said system comprising:

a. two or more tanks of foam-producing components;

b. a pump associated with each of the two or more tanks;

c. a length of modified conduit said modified conduit comprising:

i. insulation filling an inside volume of the conduit;

ii. two or more component lines running through the insulation, each line for carrying one of the foam-producing components from the two or more tanks; and iii. a nozzle head connected to an injection end of the modified conduit, through which the foam-producing components combine to make the foam;

d. a conduit injector; and e. a wireline system, wherein the conduit is pushable by the conduit injector into cavities to be injected with foam and extractable therefrom.

2. The system of claim 1, wherein the modified conduit is selected from modified flexible hose and modified coiled tubing.

3. The system of claim 2, further comprising a control room housing control elements for central control of the wireline system, injector, pumps, and elements in the modified coiled tubing.

4. The system of claim 3, wherein the control room comprises a cab, said cab being raisable for monitoring levels in tanks, better visibility and maintenance of equipment located under the cab; and said cab being lowerable for transportation.

5. The system of claim 1, wherein the modified conduit further comprises heat tracing run therethrough to maintain the foam-producing components at a predetermined temperature.

6. The system of claim 5, wherein the modified conduit further comprises a power/sensor cable line run therethrough for deployment of one or more instruments selected from a camera, one or more sensors and electrical equipment to monitor foaming operations and conditions.

7. The system of claim 6, wherein camera, sensor and electrical equipment data are viewable in the control room.

8. The system of claim 6, wherein the power/sensor cable line is in the form of fiber optic cable.

9. The system of claim 1, further comprising a purge line for providing compressed gas or air to the nozzle head.

10. The system of claim 9, wherein compressed gas or air is supplied to the purge line from a source of compressed gas or air mounted to the system or from a source of compressed gas or air at a site of foam injection operations.

11. The system of claim 1, wherein the portable system is mountable to a skid, truck flatbed or trailer for transportation to a site.

12. The system of claim 1, further comprising a generator for providing local power to the system.

13. The system of claim 1, wherein the modified conduit is run on a reel, said reel being mounted to the portable system.

14. A method for foam injection at a remote location, said method comprising the steps of:

a. transporting the portable system of claim 1 to the remote location;

b. injecting the modified conduit into a distal end of a cavity to be foamed;

c. pumping the foam-producing components from the two or more tanks via the pumps, each through a component line running through the modified conduit;

d. forming and expansion of a foam by the foam-producing components exiting a nozzle of the modified conduit and contacting one another; and e. pulling the modified conduit from the distal end of the cavity to a proximal end of the cavity, while foaming the cavity from the distal end to the proximal end as the modified cavity is pulled.

15. The method of claim 14, further comprising maintaining the foam-producing components at a predetermined temperatures by means of insulating an interior volume of the modified conduit and by providing heat tracing in the modified conduit.

16. The method of claim 15, further comprising unclogging the nozzle by blowing pressurized gas or air through the nozzle.

17. The method of claim 16, further comprising running sensors and cameras through a power/sensor cable line in the modified conduit to allow observation and data collecting of foaming operations.

18. The method of claim 14, further comprising filling the two or more tanks with foam-making chemical components from a source selected from a central stationary filling station or from tank trucks.

19. The method of claim 14, further comprising deploying a wireline system 24 into the cavity before injecting the modified conduit, to scan the cavity and take measurements prior to foam injection.

* * * * *